United States Patent [19]

Bisping et al.

[11] Patent Number: 4,770,102

[45] Date of Patent: Sep. 13, 1988

[54] PIERCING PROJECTILE WITH A WEAKENED HEAD

[75] Inventors: Bernhard Bisping, Ratingen-Hosel; Hans W. Luther, Kaarst Konstrukteur; Udo Sabranski, Willich; Peter Wallow, Dusseldorf, all of Fed. Rep. of Germany; Yves Millet, Bourges; Jean Sauvestre, Saint-Doulchard, both of France

[73] Assignees: Rheinmetal GmbH; Etat Francais, both of Paris, France

[21] Appl. No.: 657,060

[22] Filed: Oct. 3, 1984

Related U.S. Application Data

[63] Continuation of Ser. No. 308,194, Sep. 16, 1981, abandoned.

[30] Foreign Application Priority Data

Sep. 23, 1980 [FR] France ..... 80 20382

[51] Int. Cl.[4] ..... F42B 13/16; F42B 11/00

[52] U.S. Cl. ..... 102/521; 102/501; 102/506

[58] Field of Search ..... 102/364, 491–497, 102/501, 506, 517–523

[56] References Cited

U.S. PATENT DOCUMENTS

| | | | |
|---|---|---|---|
| 623,707 | 4/1899 | Dittmar | 102/518 |
| 1,301,859 | 4/1919 | McKenna et al. | 102/519 |
| 3,148,472 | 9/1964 | Hegge et al. | 102/703 |
| 3,213,792 | 10/1965 | Grenander et al. | 102/518 |
| 4,108,072 | 8/1978 | Trinks et al. | 102/518 |
| 4,123,975 | 11/1978 | Mohaupt | 102/518 |
| 4,237,787 | 12/1980 | Wacula | 102/364 |
| 4,281,599 | 8/1981 | Weber et al. | 102/364 |
| 4,362,107 | 12/1982 | Romer et al. | 102/520 |
| 4,437,409 | 3/1919 | Freymond | 102/364 |

*Primary Examiner*—Harold J. Tudor

*Attorney, Agent, or Firm*—Parkhurst & Oliff

[57] ABSTRACT

There is disclosed a kinetic energy type projectile having an armor piercing head which is intended to penetrate multi-shell targets, and even sharply angled targets. The piercing head is provided with favorably discriminated shearing regions which are axially spaced apart by distances corresponding to the thicknesses of the shells which are to be pierced by the piercing head. The shearing regions are provided by external or internal localized transverse weakenings e.g. grooves, or heat treatments by electronic bombardment, applied to the external surface of the piercing head and/or in a central bore in the piercing head. Additionally, the localized weakenings may be provided by bound collars on the piercing head.

The shearing regions are progressively stronger in a direction from the front of the piercing head so that they will shear consecutively as the head pierces successive shells of a multi-shell target.

1 Claim, 4 Drawing Sheets

PIERCING PROJECTILE WITH A WEAKENED HEAD

This is a continuation of application Ser. No. 308,194 filed Sept. 16, 1981 now abandoned.

The present invention relates to a kinetic energy piercing projectile, particularly of the arrow type, intended to permit the penetration of armoured targets with multiple armoured shells, even for considerable target angles.

Kinetic energy projectiles and particularly arrow-type projectiles are conceived to destroy every type of cruiser tank existing at present with a large degree of probability of reaching their target. The so-called "heavy" targets act as a reference to test the intrinsic piercing value of a kinetic energy projectile, and they are: the single heavy tank (armour) targets (S.C.L.), double heavy tank (armour) (D.C.L.) and triple heavy tank (armour) (T.C.L.). Other so-called new targets, either passive (multi-stage or not), such as, for example, the commercial English armour plating under the name for armour-plating CHOBHAM, or active, are effective against certain kinetic energy projectiles.

Faced with the difficulties of piercing such targets, the conception of projectiles has been directed towards products permitting as high as possible a surface energy on impact. In order to do this, the use of dense materials with high mechanical properties, such as tungsten or uranium alloys, has proved to be necessary to ensure that the projectiles are in good mechanical order when launched and on impact.

One-piece kinetic energy projectiles using such materials and optimised against various, relatively thick homogeneous armour plating have rear effects of little significance on light armour plating, give average penetration results on sharply tilted targets (angle of incidence above 70°) and mediocre results on multiple targets.

When such projectiles are used against multiple shell targets, such as the triple heavy tank (armour) target, it is often noted that after the first armoured shell has been pierced, considerable distortions are produced on the piercing head of the penetrator.

The surface energy is then greatly diminished on the second armoured shell and is not sufficient to pierce the third. Added to this phenomenon of distortion are transverse ruptures in the penetrator in very weak areas, such as, for example, grooves.

These ruptures, which arise on impact on the first armoured shell, have the effect of sharply reducing the usable mass of the projectile for piercing the following plates, which is very detrimental to the effectiveness of the projectile.

The aim of the present invention is to remedy the above disadvantages by producing a projectile capable of piercing in particular multiple armour platings and of reducing the tendency to ricochet off heavily inclined targets, this being achieved by favourably discriminating predetermined points of the projectile to be ruptured, bearing in mind the type of target hit.

The object of the invention is therefore a piercing, kinetic energy projectile, particularly of the arrow-type, comprising a piercing head of which at least one transverse section of the piercing head includes one or several means of localised weakening.

In a preferred embodiment, the piercing head comprises at least two transverse weakened sections, the weakening of each of these sections being effected in such a manner as to decrease from the front to the rear of the piercing head.

Weakened areas can thus be made on the exterior of the piercing head, and, in the case where the latter comprises a central bore, the weakened areas can be made along the said bore.

In the first case, the first means of weakening are grooves situated on the external circumference of the piercing head, the respective depths of each groove becoming smaller from the front to the rear of the piercing head.

In the other case, the first means of weakening are made up of grooves cut into the internal circumference of the central bore of the piercing head, the respective depths of each groove becoming smaller from the front towards the rear of the piercing head.

The bore can also be staggered, whereby it diminishes from the front towards the rear, whereby each change in section between the different stages constitutes a means of localised weakening.

In a similar manner, second means of weakening can be used, such as localised thermal or mechanical treatments effected on the external circumference of the piercing head, or, if there is a central bore, on the internal circumference of the latter, weakening each area in a manner decreasing from the front to the rear of the piercing head.

In another embodiment, the piercing head comprises a cap of a hard material made up of one or several tubular or truncated elements defining between them weakened areas fastened rigidly to the piercing head.

Finally, in the case of a bore being present, one or several cylinders or collars of a hard material can be arranged in a fixed manner on the interior of the central bore of the head, defining between them weakened areas.

Of course, any one or more of the different means of weakening provided above can be combined without departing from the scope of the invention.

DESCRIPTION OF PREFERRED EMBODIMENTS

Figure 1:
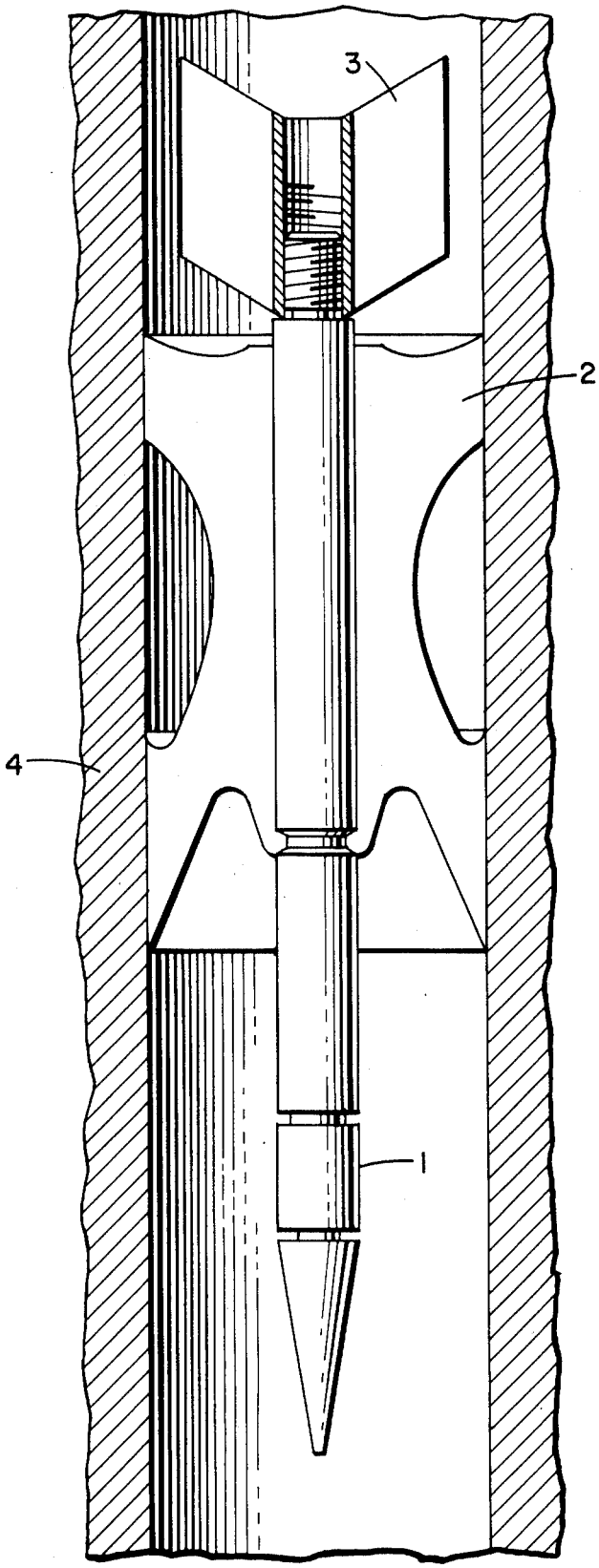
FIG. 1 is a schematic illustration of a kinetic energy projectile according to the invention, fitted with its sabot and its fins, in the interior of the tube from which it is launched.

Referring to FIG. 1 of the drawings, there is shown a kinetic energy projectile 1, fitted with its sabot 2 and fins 3, in a launching tube 4.

Figure 2:
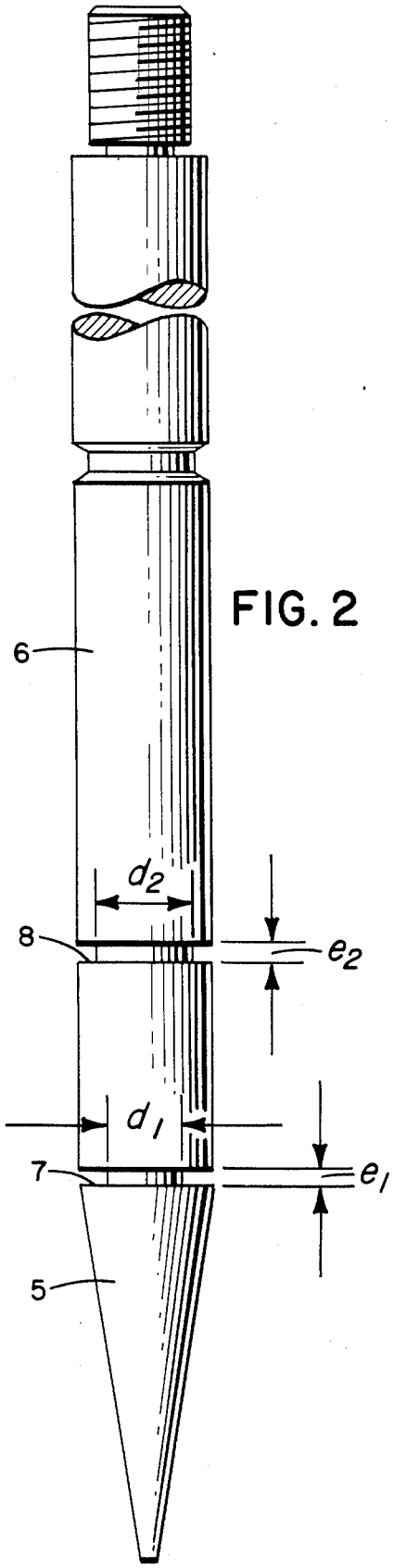
FIG. 2 shows the projectile, to an enlarged scale, but with the launching sabot and stabilising fins removed.
Figure 3:
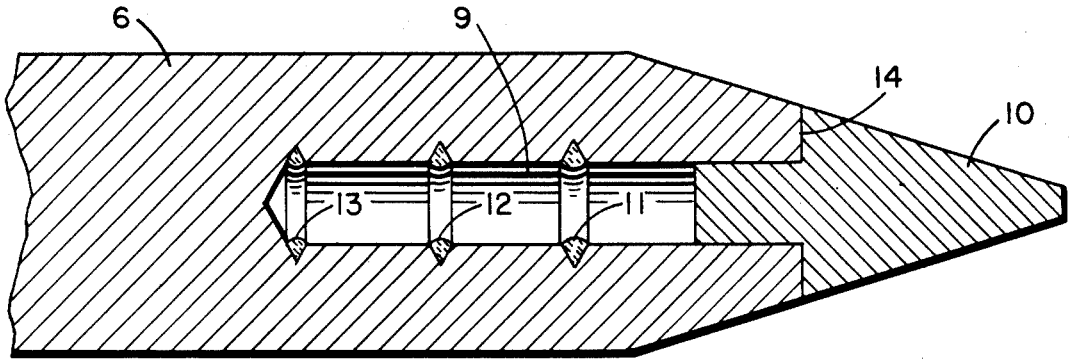
FIGS. 3 to 11 show different constructions of piercing head for the projectile.
Figure 4:
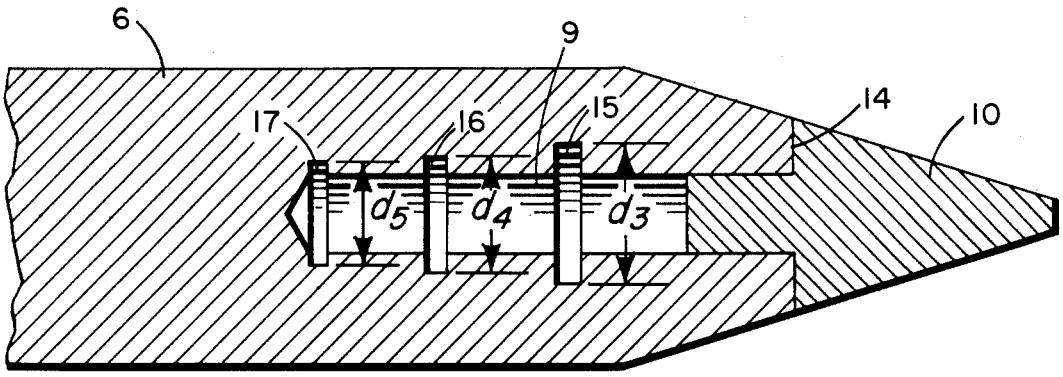
Figure 5:
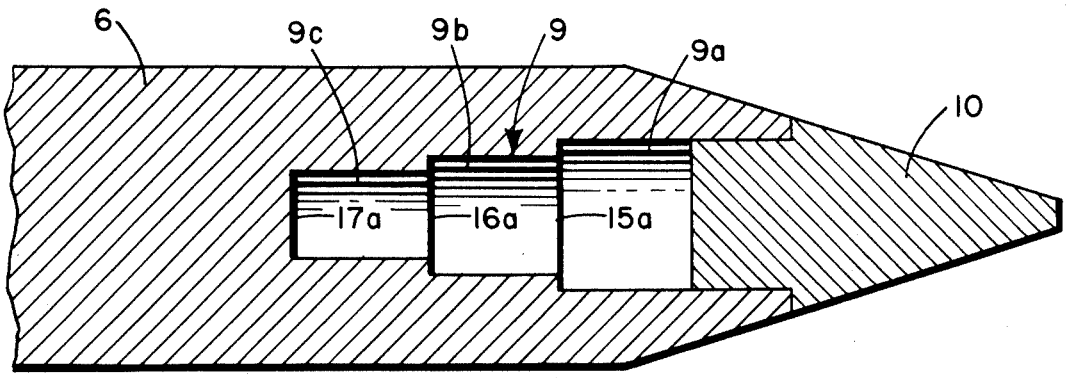

According to FIG. 2, a piercing head 5 of the projectile is separated from a body 6 by at least one annular groove 7, or preferably by two grooves 7 and 8 with the respective thicknesses $e_1$ and $e_2$, which are equal or not, and with the diameters $d_1$ and $d_2$. The groove 7, or grooves 7 and 8, constitute localised weakening of the piercing head 5 at favourably discriminated regions.

At the moment of impact on a multi-shell target, the piercing head 5 pierces the first armoured shell and, due to the shock, is separated from the body 6 due to shearing and bending at right angles to the groove 7. On passing to the second armoured shell or plate, the head breaks at the level of the second groove 8.

To increase the certainty of first rupture at the level of the groove 7, and then second rupture at the level of the groove 8, a greater depth is given to the groove 7 than to that of the groove 8.

Thus, for example, for an arrow head with an external diameter of 24 mm, there will be a diameter d1 equal to 14 mm, and a diameter d2 of 18 mm.

In the embodiments shown in FIGS. 3, 4, 5 and 7, 8, 9 an arrow head comprises a central recessed bore 9 closed at its front section by an inserted tip 10 of a metal identical or not to that of the body of the projectile and forming the front of the piercing head. The localised weakening can then be effected on the internal surface of the bore by thermal treatment on the annular areas such as those shown at 11, 12 and 13 in FIG. 3. The treatment will be effected with an intensity decreasing from the front (area 11) towards the rear (area 13), the weakest area i.e. the most intense treatment being the surface 14 separating the tip 10 from the body 6.

According to one embodiment, the thermal treatments can be replaced by annular grooves on the interior of the bore (FIG. 4) such as 15, 16, 17, having the diameters $d_3$, $d_4$, $d_5$ at the bottom of grooves such that $d_3 > d_4 > d_5$.

According to another embodiment, the central recessed bore 9 is staggered or stepped in several parts 9*a*, 9*b* and 9*c* with diameters decreasing from the front towards the rear. Each change in section 15*a*, 16*a* and 17*a* constitutes a means of localised weakening.

Figure 8:
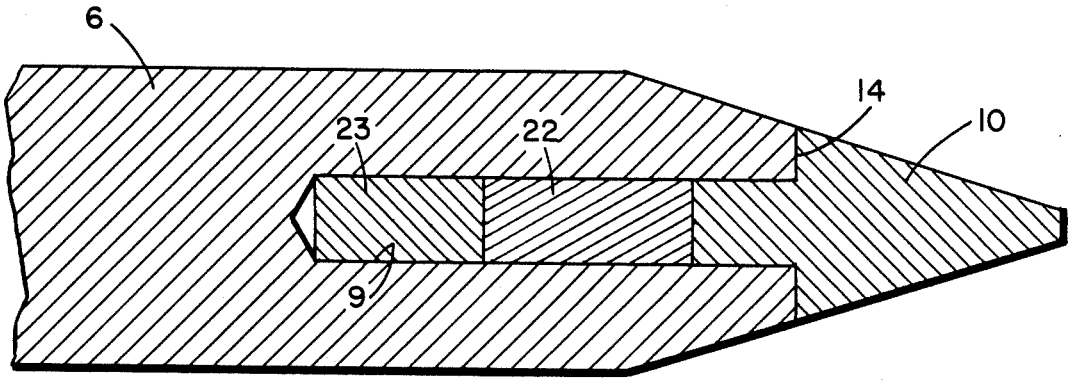
Figure 9:
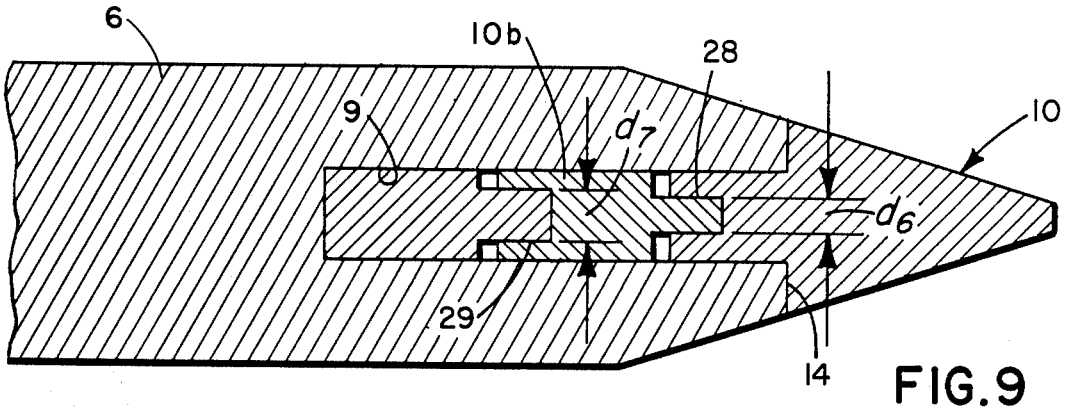
Figure 12:
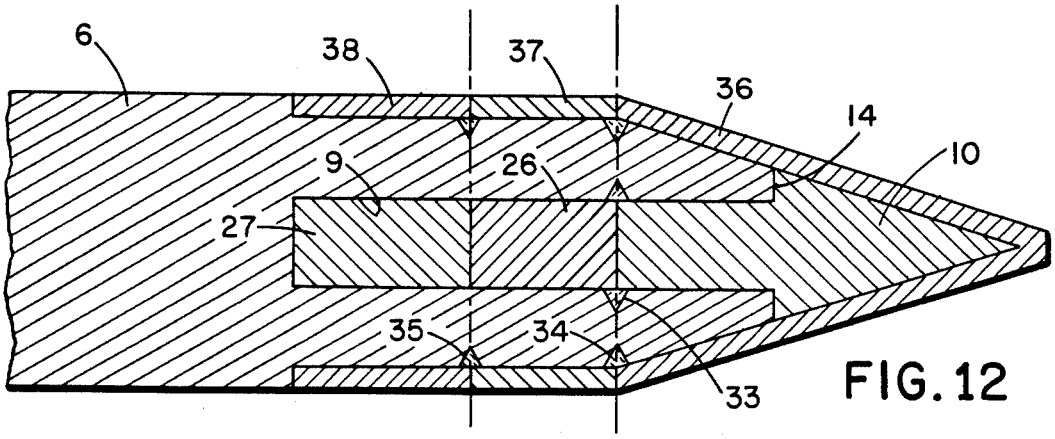
FIG. 12 illustrates an embodiment in which several weakening means shown in the preceding figures have been combined, in such a way as to achieve an optimal penetrating effect into a multi-shell target.

According to another variation, there can be arranged in the interior of the bore 9 inserted portions in a material identical or not to that of the projectile, which are either tubular (such as 18 to 21 in FIG. 7) or solid cylinders, such as 22, 23 or 26,27 in FIGS. 8 and 12.

The weakened areas will then be located at right angles to the continuity sections between the different inserted parts.

In another embodiment, the rupture areas can be favourably discriminated by including on the solid, cylindrical, one-piece portion 10*b* of the inserted tip, with the general reference 10 (see FIG. 9), flanges 28 and 29 with the diameters $d_6$, $d_7$, increasing from the front to the rear of the projectile.

Figure 6:
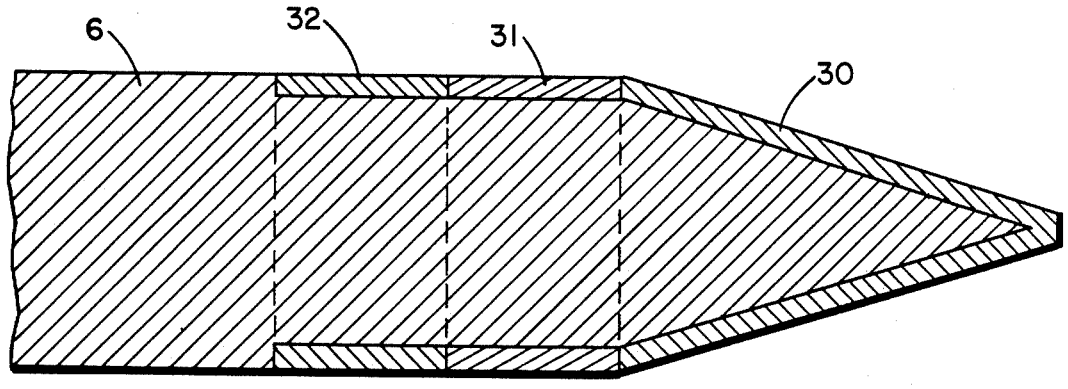
Figure 7:
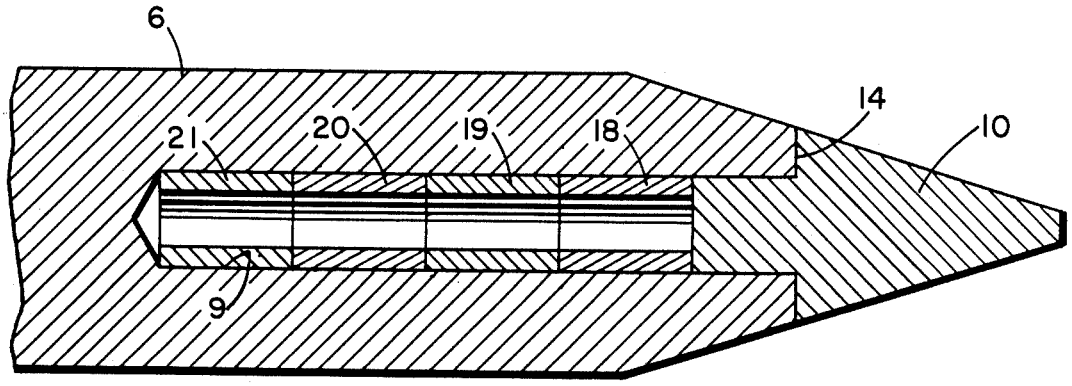

The invention also covers another embodiment in which the piercing head of the projectile comprises a truncated conical cap bound in a metal identical or not to that of the projectile, on which are made the beginnings of a rupture either by localised thermal treatment if the cap is one-piece, or by making the cap in several portions, one truncated 30 (see FIG. 6) and the others cylindrical 31, 32.

The length of each portion of the cap or the distance separating the thermally treated areas is determined experimentally with respect to the nature of the envisaged targets and to the energy of the projectile on impact in such a manner that the rupture at the level of the weakened area does not take place until the envisaged thickness of each target shell has been traversed.

Figure 10:
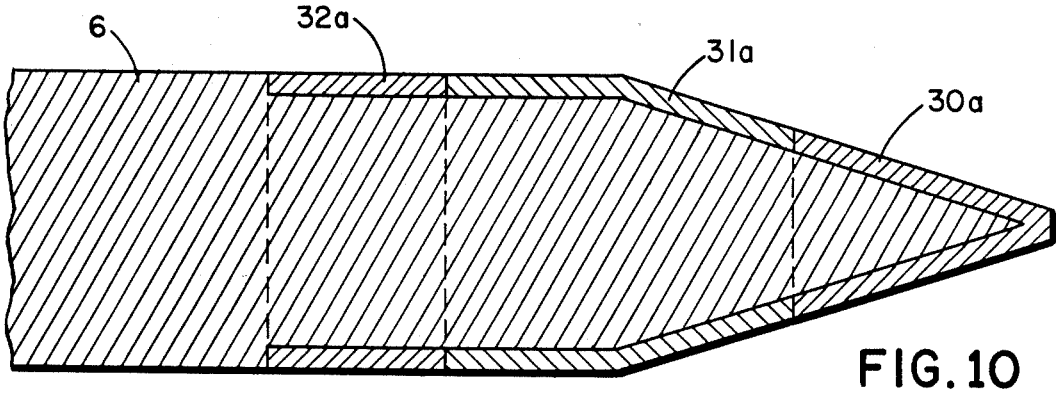

Thus, the front truncated section 30*a* (FIG. 10) of the cap can be very short, whilst the middle section 31*a* will be conical-truncated and the section 32*a* cylindrical.

Figure 11:
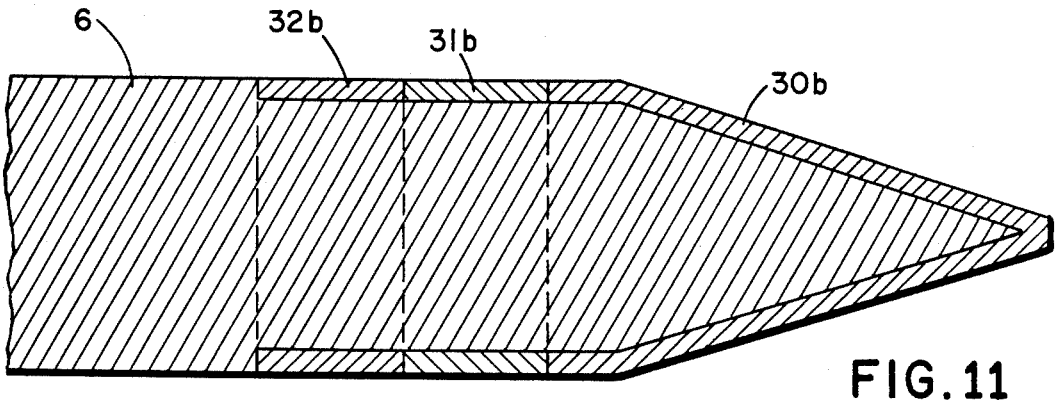

On the other hand, (FIG. 11), if the aim is to destroy a target whose first shell crossed is thicker than the following shells, the length of the first section of the cap will be increased and will become conical-truncated 30*b*, the other two parts of it then being cylindrical (31*b* and 32*b*).

In an optimal embodiment, all or some of the above-described means of weakening the piercing head according to the invention can be combined. Thus, FIG. 12 shows the front section of a projectile according to the invention which comprises a bore 9 into which have been inserted solid cylindrical portions 26 and 27, the bore being closed at its front extremity by a tip 10.

Furthermore, localised thermal treatments 33, 34 and 35 have been carried out, on the internal circumference of the bore (33) and on the external portion of the head (34 and 35) in the transverse planes situated at right angles to the separating surface between the tip 10 and the piece 26 for the treatments 33 and 34, and at right angles to the separating surface of the pieces 26 and 27 for the treatment 35. Moreover, the head comprises a cap in three parts 36, 37 and 38, whose continuity sections are situated in the said transverse planes.

The projectile can also comprise all the other possible combinations of the embodiments described above without departure from the scope of the invention.

The latter applies to all the types of kinetic energy projectile and particularly, though not exclusively, those of the arrow-type intended to pierce multiple targets.

We claim:

1. A kinetic energy arrow-type projectile having a sabot mounted thereon and intended to penetrate multi-shell targets, comprising:

an armor piercing head formed by a forward portion of the projectile; and at least two axially spaced grooves provided on an external surface of said piercing head at a forward part of said piercing head to provide two predetermined, favorably discriminated, locally weakened transverse shearing sections;

wherein respective depths of the grooves decrease in a direction from the front to the rear of said piercing head to effect weakening of said transverse shearing sections of decreasing intensity from front to rear, and further wherein said grooves are spaced from one another such that the piercing head is successively fractured at said transverse shearing sections upon piercing successive shells of a target while leaving a major part of the piercing head intact.

* * * * *